US006429766B1

(12) United States Patent
Glatz-Reichenbach et al.

(10) Patent No.: US 6,429,766 B1
(45) Date of Patent: Aug. 6, 2002

(54) ELECTRICAL DEVICE COMPRISING A PTC POLYMER ELEMENT FOR OVERCURRENT FAULT AND SHORT-CIRCUIT FAULT PROTECTION

(75) Inventors: Joachim Glatz-Reichenbach, Baden; Ralf Strümpler, Gebenstorf, both of (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/767,738

(22) Filed: Jan. 24, 2001

(30) Foreign Application Priority Data

Jan. 25, 2000 (EP) ..... 00810069

(51) Int. Cl.[7] ..... H01C 7/13
(52) U.S. Cl. ..... 338/22 R; 338/22 SD
(58) Field of Search ..... 338/22 R, 22 SD

(56) References Cited

U.S. PATENT DOCUMENTS 4,317,027 A 2/1982 Middleman et al.
4,352,083 A * 9/1982 Middleman et al. ..... 338/23
4,486,737 A * 12/1984 Ott ..... 338/22 R
4,845,838 A * 7/1989 Jacobs et al. ..... 29/611
4,857,880 A * 8/1989 Au et al. ..... 338/22 R
4,884,163 A * 11/1989 Deep et al. ..... 361/58
4,951,382 A * 8/1990 Jacobs et al. ..... 29/611
5,045,673 A * 9/1991 Kelly ..... 219/553
5,122,775 A * 6/1992 Fang et al. ..... 338/22 R
5,414,403 A 5/1995 Greuter et al.
5,416,462 A * 5/1995 Demarmels et al. ..... 338/22 R
6,133,820 A * 10/2000 Duggal et al. ..... 338/22 R

FOREIGN PATENT DOCUMENTS

| | | |
|---|---|---|
| DE | 196 26 238 | 1/1998 |
| EP | 0 038 715 | 10/1981 |
| JP | 3-208301 | * 9/1991 |

* cited by examiner

*Primary Examiner*—Karl D. Easthom
(74) *Attorney, Agent, or Firm*—Burns, Doane, Swecker & Mathis, L.L.P.

(57) ABSTRACT

The invention relates to an electric device with a PTC polymer element having a constriction. The constriction defines a web extending in a main current direction over a length longer than in the prior art, namely longer than 5 mm, preferably longer than 15 mm. Further, the aperture angle of the PTC polymer material at the ends of the web is larger than 100°. A preferred choice of material is given, further. The invention achieves very high voltage-withstand capabilities.

15 Claims, 2 Drawing Sheets

Figure 1:
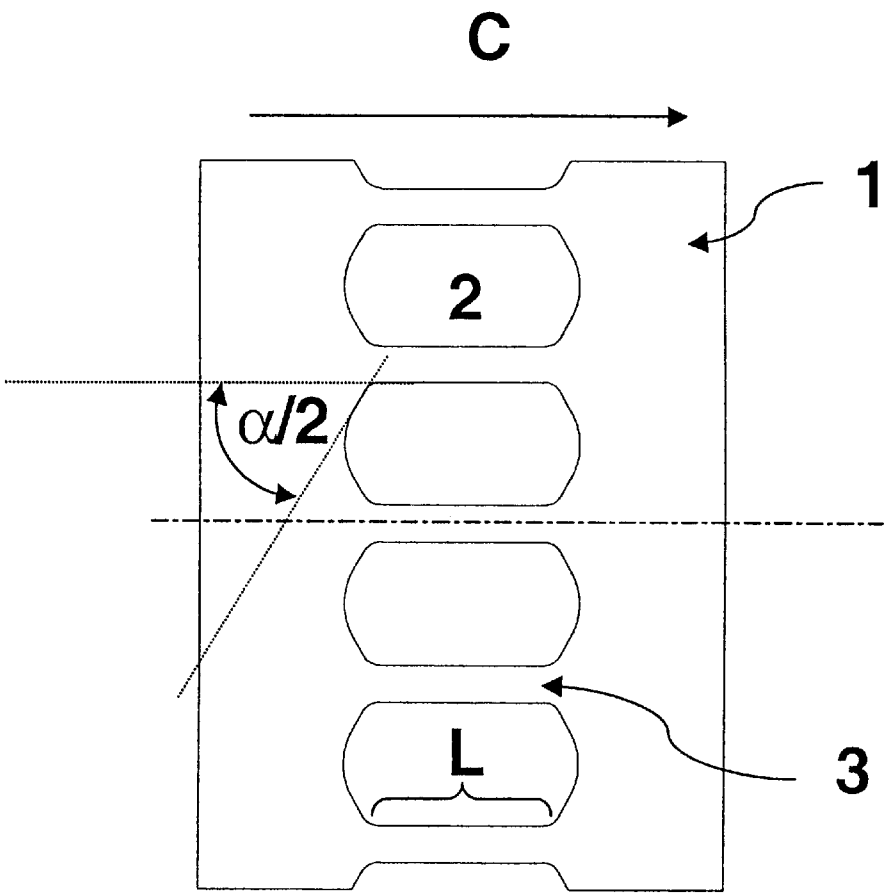

ELECTRICAL DEVICE COMPRISING A PTC POLYMER ELEMENT FOR OVERCURRENT FAULT AND SHORT-CIRCUIT FAULT PROTECTION

BACKGROUND OF THE INVENTION

1. Field of the Invention

The present invention relates to an electrical device with a PTC polymer element. Namely the present invention relates to such PTC polymer elements in which a constriction in terms of a reduction of the cross-sectional area perpendicular to a main current direction is formed, wherein that constriction defines a web. The term web relates to a portion of the PTC polymer element extending in that main current direction over a length wherein a minimum cross-sectional area of that constriction is included in that web and that web essentially maintains said minimum cross-sectional area over that length of extension.

2. Prior Art

EP 0 655 760 A2 shows that electrical devices comprising PTC polymer elements can effectively be used for overcurrent limitation purposes. In this document the PTC polymer element is connected in series with a load interrupter. It is intended that the PTC polymer element limits overcurrents to current values that can easily be interrupted by the load interrupter.

The high-voltage capabilities of the PTC polymer elements can be improved according to the teaching of U.S. Pat. Nos. 5,313,184 and 5,414,403. These documents propose to combine PTC polymer elements and varistor elements or linear resistor elements in order to avoid too high local electrical fields within the PTC polymer material during switching. A nonlinear response behaviour of the PTC polymer material can be distributed in this way. It is to be noted that the term PTC polymer element as used within this description and in the claims also covers such PTC polymer elements which besides the mere PTC polymer material comprise filler materials or elements with linear resistance characteristics or resistance characteristics being nonlinear with temperature, electrical field strength (varistors), pressure etc.

What is also known in the prior art is to provide PTC polymer elements having constrictions in the current carrying cross-sectional area, i.e. in the cross-sectional area perpendicular to the main current direction. Such constrictions can be found e.g. in EP 0 038 715 B1. This document intends to achieve a very rapid tripping of the PTC polymer material within the constriction by this specific design. What is also shown in this document, namely in FIG. 5C, is a constriction defining a web, that web extending in the direction between two electrodes, consequently in the main current direction, over a certain length.

SUMMARY OF THE INVENTION

Based on the above cited prior art the technical. problem underlying the present invention is to provide a novel electrical device with a PTC polymer element with improved electrical performance.

This problem is solved by an electrical device according to claim 1. In this electrical device, a web of a constriction in the PTC polymer element extends over a length of at least 5 mm. Even more preferred values are lengths of at least 7, 10, 15 or even 20 mm.

With these values for the length of the web, the switching capability in terms of voltage of the PTC polymer element, and thus of the complete electrical device, can strongly be improved compared to the prior art. E. g. the above named EP 0 038 715 does not mention such long webs at all. Now, the inventors have found that the voltage resistivity of a single trip zone within the PTC polymer material can much be improved by using a long web, that web, by carrying the highest current density within the PTC polymer element, being predetermined to include the trip zone. By avoiding a movement of the borders of the trip zone out of the web, a favourable combination of accelerated trip dynamics on the one hand and high voltage-withstand capability on the other hand can be secured. Thus, for a fast electrical device with voltage switching capabilities in a voltage range of e.g. 690 Vrms, the electrical device according to the invention can preferably be used without any series connection of trip zones.

Thus, the invention is used for protecting an electrical circuit of overcurrent and short-circuit current, preferably at a system voltage of 690 Vrms and more. Therein, preferably, the whole range of fault scenario from only small overcurrents to prospective short-circuit currents of e.g. up to 50–100 kA should be safely limited and, in a preferred combination with a load switch, switched off.

An important advantage of the invention in its combination of fast and voltage stable current limitation lies in the fact, that fast tripping reduces the let-through energy which can, if too large, damage the PTC polymer element. Thus, a fast enough current limitation also in cases of high voltages across the electrical device means that its action can be repetitive, e.g. at least five times for heavy short-circuit limitation. Therefore, the typical time to suppress a short-circuit current to zero should be much smaller than a quarter period of the respective system, e.g. much smaller than 5 ms.

In view of a sufficient current-carrying capacity, the effect of cooling of the web by the rest of the PTC polymer volume can be important. Relatively high current loads necessitate such cooling in order to avoid a tripping at high but permissible current values. This aspect of the invention has to be considered together with the fact that a very high voltage capacity can best be reached by very long webs. For the system voltage range between e.g. 500 Vrms and 12 kVrms, it is therefore preferred, to use webs not longer than 150 mm. Depending on whether the voltage-withstand capability or the current-carrying capability is more important, also webs not longer than 80, 40 or even not longer than 30 mm can be preferred.

However, this does not generally exclude to use very long webs in the area of for example 120 mm (for e.g. 12 kVrms) or even 360 mm (e.g. for 36 kVrms), according to the invention.

Further, in order to improve the thermal conduction to webs of considerable length, holes adjacent to such webs can be filled by an electrically insulating material instead of air.

A second aspect important for the above named cooling effect of the PTC polymer volume for the constriction and the web is the aperture angle of the constriction, as seen from the web. This aperture angle is defined in one longitudinal sectional plane containing the main current direction. At least in one of these planes, that aperture angle should preferably be at least 1000 in total. As can be taken from the embodiments, this total angle is to be regarded as a sum of a right-hand aperture angle and a left-hand aperture angle having their respective apex points separated from each other. Essentially, these apex points are located at the right and the left side, respectively, of the web as seen in the main current direction. It is not necessary that these two partial aperture angles are identical, but it is preferred. Further, the line segments on both side of the constriction being angled by the aperture angles with respect to the main current direction do not necessarily have to be regularly shaped, as appears from the definition of an angle. It is sufficient, if a line segment can be defined as a mean value in order to define an aperture angle. However, essentially straight inclined flanks on both sides of the web are preferred.

Even more preferred lower limits for the total aperture angle are 105°, 110°, 115° and 120°. As already stated above, these minimum aperture angles relate to at least one longitudinal sectional plane through the constriction. All the longitudinal sectional planes through the constriction can show different aperture angles, but preferably they are the same. However, also a two-dimensional constriction, wherein only one longitudinal sectional plane shows the above defined aperture angle, and a second longitudinal sectional plane perpendicular to the first one shows no constriction at all, is possible. Usually, this form is easier to manufacture.

In any case, the combination of high current-carrying capacity and fast tripping dynamics can be achieved. Especially, large aperture angles mean short overall lengths of the PTC polymer element in the main current direction in that the constriction(s) is/are short but pronounced. Thereby the overall ohmic resistance in the normally conducting state can be minimised. This is especially important, because the, according to the invention preferred, long webs necessarily lead to a certain increase in ohmic resistance compared to shorter webs. However, with these long webs series connections of shorter webs can be avoided or at least the number of series-connected constrictions be reduced, which again leads to an improvement of the overall ohmic resistance.

Also, it has been proved, that for medium and high fault currents the above minimum aperture angles provide for a simultaneous tripping action of series-connected constrictions so that such series connections can be realised with reduced risk of destruction of the first tripping constriction. Further, this problem can be alleviated by a parallel connection of normal or varistor resistors. If, however, series connections are completely avoided, parallel resistors or varistors are only needed to limit the maximum switching voltage to suitable values, and also smallest overcurrents can be switched off.

According to the above, it is possible to increase the voltage-withstand capacity of the electrical device according to the invention preferably by means of a lengthening of the web structure compared to a series connections of constrictions. Further, in order to further improve the current-carrying capacity for a certain minimum cross-sectional area of one constriction, parallel connections can be chosen. All in all, also a matrix array of constrictions is possible. Preferably, these combinations occur in the same PTC polymer piece without avoidable material transitions.

In any case, the overall reduction of the cross-sectional area perpendicular to the main current direction should preferably be larger than by a factor of three, more preferably by a factor of four or more. As regards the material aspect of the invention, preferably a polymer matrix essentially made of a thermoplastic polymer is used. The preferred choice for this thermoplastic material is polyethylene. With a thermoplastic characteristic of the PTC matrix, the PTC polymer element as a whole can be formed by injection moulding or extrusion, both being very economical methods. For these forming methods, it is preferred to use high-density polyethylene.

Preferred quantitative ranges for the inclusion of the conductive filler material inherent to PTC polymer materials are 20–50 Vol.-%, more preferably 25–46 Vol.-% and even more preferably 30–43 Vol.-% (with respect to the total volume of the PTC polymer material). A preferred choice for this (first) conductive filler material is $TiB_2$.

Besides that first filling material, the PTC polymer material may include a second filler material having varistor characteristics. This second filler material preferably is SiC. The preferred quantity ranges are 10–30 Vol.-%, preferably 12–28 Vol.-% and more preferably 14–26 Vol.-% of that second filler material.

These filler materials are included in powder form dispersed in the polymer matrix. The first filler material should be of metallic conductivity, i.e. should have a specific resistance of $10^{-3}$ Ωcm, at most. This excludes e.g. carbon black. The second filler material having varistor characteristics should have a specific resistance of not more than 50 Ωcm at electric fields of 2000 V/cm and more. Its specific resistance should be larger than $10^{-2}$ Ωcm on the other hand.

Further the average particle size of the second filler material should be larger than the one of the first filler material, namely by a factor of 2–5. Preferred ranges for the particle sizes are 10 μm to 50 μm for the first filler material and 20 μm to 250 μm for the second filler material.

The above mentioned thermoplastic polymer matrix is preferably comprised in an amount of 30–55 Vol.-% and more preferably of 37–50 Vol.-%. According to the results of the inventors, the above specified PTC polymer material, at a predetermined voltage, shows a notably large zone of high resistance ("hot zone"). If, according to the invention, the length of the web in the constriction is large enough to include this hot zone, remarkably high voltage withstand capacities can be achieved. Further, with a design according to the invention, the damages produced in the PTC polymer element during tripping action can obviously be reduced compared to conventional examples. This has let to the result, that the increase of the "cold resistance" i.e. the resistance in the normal conducting state, after especially the first tripping action is much lower than conventionally. As appears from the description of the embodiments following hereinbelow, this seems to be a result of the reduced let-through energy.

DESCRIPTION OF A PREFERRED EMBODIMENT

Figure 2:
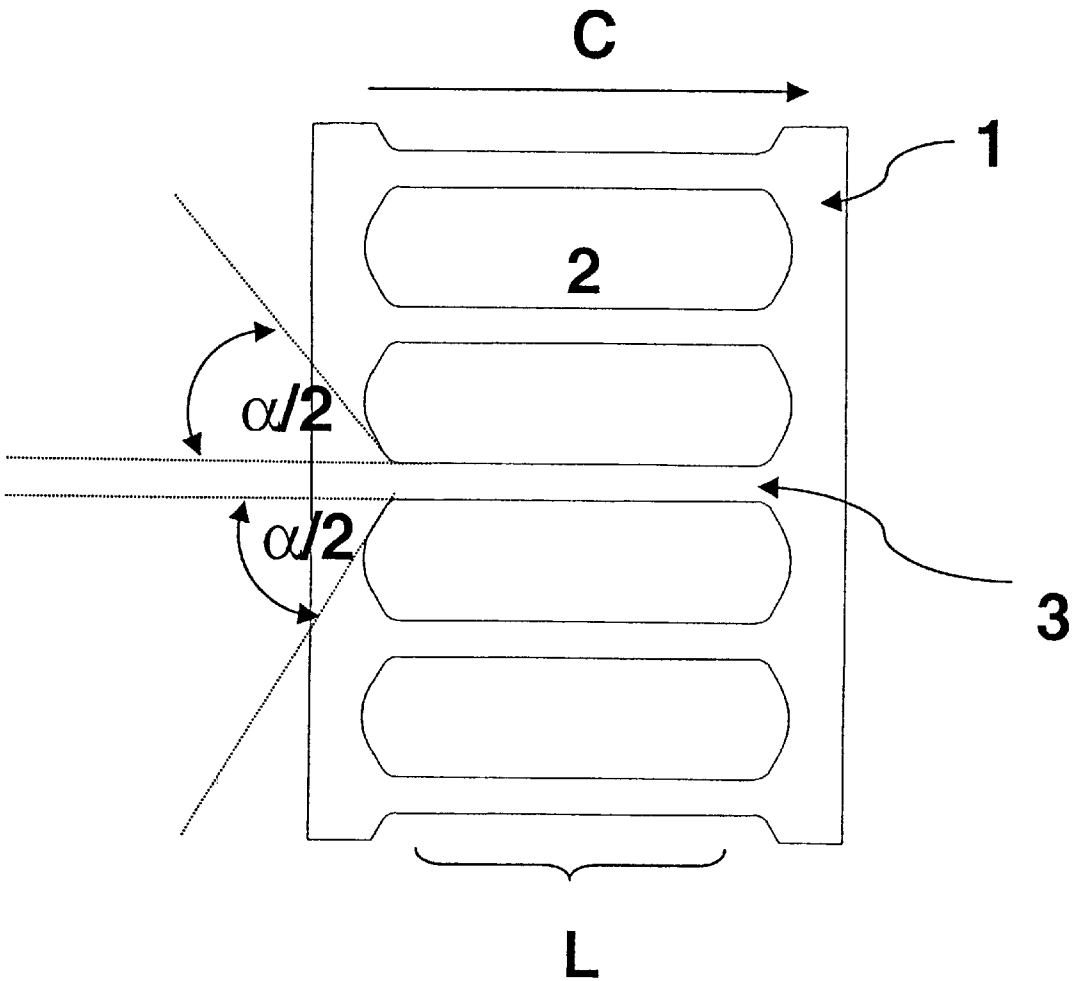

In the following, preferred embodiments of the invention will be described with reference to the drawings in which FIG. 1 is a schematic layout of a PTC polymer element in an electrical device according to the invention; and FIG. 2 is a schematic layout of a further PTC polymer element according to a second embodiment having a longer web length.

FIG. 1 shows a schematic layout of a PTC polymer element 1 in an electrical device according to the invention. The electrical device, in the present embodiment, is a current limiting and interrupting means comprising a conventional load switch in series connection with PTC polymer element 1 according to this invention. The voltage across PTC polymer element 1 is used to detect the resistivity state of PTC polymer element 1 and to trigger the load switch in order to completely interrupt currents which have been limited by PTC polymer element 1 before. This combination is, with a conventional PTC polymer element, known in the prior art. It has the advantage that the current limiting effect is much faster than with conventional switches and that a load switch of moderate size can be used because the currents to be interrupted are not the prospective short-circuit currents of the circuit, but much smaller. Reference is made to the prior art cited in the introduction of this description.

PTC polymer element 1 shown in the figure consists of a 40 Vol.-% high-density polyethylene matrix with 40 Vol.-% powdered $TiB_2$ and 20 Vol-% As-doped SiC, according to the above mentioned specifications.

In the figure, the main current direction is given by arrow C. PTC polymer element 1 shows holes 2 defining constrictions with webs 3. Therein, PTC polymer element 1 has a two-dimensional shape, i.e. the shape shown in the figure can be regarded as a cross-section through PTC polymer element 1 at any position in the direction perpendicular to the plane of the figure.

Thus, each web 3 corresponds to the minimum cross-section perpendicular to main current direction C. At each of its two ends, each web 3 shows a left and a right aperture angle, each designated $\alpha/2$. $\alpha/2$ is 60° so that the full aperture angle a is 120° in this example.

Important is the length of each web 3 between the two apertures of the PTC polymer material at each web end. This length is given by L and is 9 mm in this example. Incidentally, each web 3 is 2 mm wide and spaced apart from its neighbour web by 6.75 mm.

FIG. 2 shows a similar PTC polymer element the only difference being a web length L of 20 mm in this case. In both cases the cross-section reduction factor is 4 leading to a minimum cross-section of 0.4 $cm^2$.

As can easily be seen in the figures a parallel connection of 5 webs 3 has been chosen in order to achieve a certain current-carrying capability of PTC polymer element 1. A concentration of the complete reduction in cross section to one constriction could lead to thermal problems. However, there is no series connection of constrictions. According to the invention, it is preferred to use only one constriction with one web in terms of series connection. In case of very long webs 3 for high voltages, this might lead to certain small reductions in current carrying capability in some case. However, the underlying thermal problems can be managed by means of a complete design as by the aperture angles, the filling of the holes and so on. On the other hand, especially with small overcurrents which lead to only slow tripping of the PTC polymer materials, a simultaneous tripping of series-connected constrictions cannot always be secured.

The PTC polymer element 1 shown in the figures is a test prototype cut by a water jet technique. Therefore, holes 2 have somewhat rounded corners with a radius of curvature over approximately 1 mm at each apex of each half aperture angle and a radius of curvature of approximately 3.75 mm between the respective two straight flanks under 60° to main current direction C, i.e. at the beginning and the end of each hole 2 in main current direction C.

These curvatures are artefacts and can essentially be avoided in case of injection moulding or extrusion techniques. However, they do not disturb the invention seriously, namely, the radius of curvature of 1 mm is definitely smaller than the straight flanks defining the aperture angles and the width of web 3.

Electrical contact to PTC polymer 1 shown in the figures can be made in any conventional way, e.g. by pressing in of metal foils, by metal inlays, by fusing in of metal parts and so on. In order to improve the thermal conduction to and within webs 3, holes 2 are filled with sand.

PTC polymer elements as shown in the figures have been tested in short-circuit tests with different web lengths L. The following results have been obtained.

| L (mm) | Ro (mOhm) | Ro'Ro | no. of interruptions |
|---|---|---|---|
| 7 | 140 | 640/140 = 4,6 | 2 |
| 9 | 158 | 386/158 = 2,4 | 3 |
| 11 | 194 | 480/194 = 2.5 | 3 |
| 13 | 199 | 550/199 = 2.8 | 4 |
| 15 | 151 | 503/151 = 3.3 | 4 |
| 18 | 194 | 695/194 = 3.6 | 6 |
| 20 | 223 | 913/223 = 4.1 | 9 |

These results have been obtained at a system voltage of 690 $V_{rms}$ with a prospective short-circuit current at 50 Hz of 12 $kA_{pros}$. Besides the web length L of 9 mm and 20 mm according to the embodiments shown in the figures, also web lengths L of 7, 11, 13, 15 and 18 mm have been tested. Depending on the web length L, the rated current varies somewhat between approximately 5A for L=7 mm and 3A for L=20 mm (minimum cross-section 0,4 $cm^2$). The maximum currents observed were in the order of 1.2 kA and 1.3 kA and appeared after approximately 0.35 ms. The current is reduced to irrelevant values after 0.5 ms at maximum. Thereby, the let-through energy could be reduced to very small values.

As can be seen, longer web lengths L lead to increased resistance values Ro before tripping. However, after a first trip, the cold resistance Ro' is somewhat increased but remains in the same order after repeated trips. The increased cold resistance after tripping can be better for longer web lengths, as appears from their results. Further, longer web lengths improve the ability for repetitive tripping without destruction. All PTC polymer elements had to be replaced after the number of trips given in the table. However, in each case the last tripping action was successful to interrupt the current.

Also the PTC polymer element with L=7 mm could show a better repetition of tripping if used with reduced system voltage. The L=7 mm element had a voltage withstand capability of approximately 1.1 kV which is at the lower limit for a 690 $V_{rms}$ system voltage. Accordingly, longer webs were better in this respect.

In these tests a parallel varistor has been used in order to reduce the maximum voltage below 1.5 kV. However, the varistor can be omitted if an increased stress of the PTC polymer elements 1 and thus reduced numbers of repetitive switching can be tolerated.

What is claimed is:

1. An electrical device for overcurrent fault and short-circuit current fault protection, comprising:

a PTC polymer element;

electrical contacts applied to the PTC polymer element and defining a main direction of current flow in a section of the PTC polymer element, the section of the PTC polymer element comprising first and second holes arranged to form a constriction of PTC polymer between the first and second holes and extending in the main direction of current flow, wherein;

the first hole comprises a first surface parallel to the main direction of current flow, the first surface forming a first boundary of the constriction;

the second hole comprises a second surface parallel to the main direction of current flow, the second surface forming a second boundary of the constriction; and the portion of the constriction between the first and second surfaces has a minimum cross-sectional area of the constriction and extends in the main direction of current flow over a length of at least 5 millimeters.

2. An electrical device according to claim 1, wherein said length is at most 150 mm.

3. An electrical device according to claim 1, wherein said PTC polymer element comprises a thermoplastic polymer matrix.

4. An electrical device according to claim 3, wherein said thermoplastic polymer matrix is essentially made of polyethylene.

5. An electrical device according to claim 4, wherein said PTC polymer element is an injection-moulded part or an extrusion part comprising a matrix essentially made of high-density polyethylene.

6. An electrical device according to claim 1, wherein said PTC polymer element comprises a first conductive filler material in an amount of 20–50 Vol.-%.

7. An electrical device according to claim 1, wherein said PTC polymer element comprises a first conductive filler material being $TiB_2$.

8. An electrical device according to claim 1, wherein said PTC polymer element comprises a second filler material of varistor characteristic.

9. An electrical device according to claim 8, wherein said second filler material is doped SiC.

10. An electrical device according to claim 8, wherein said second filler material is comprised in an amount of 10–30 Vol.-%.

11. An electrical device according to claim 3, wherein said thermoplastic polymer matrix is comprised in an amount of 30–55 Vol.-%.

12. An electrical device according to claim 1, wherein a hole adjacent to said web is filled with an insulating material.

13. An electrical device according to claim 11, wherein said thermoplastic polymer matrix is comprised in an amount of 37–50 Vol.- %.

14. An electrical device according to claim 1, wherein said PTC polymer element comprises a first conductive filler material in an amount of 30–43 Vol.-%.

15. An electrical device according to claim 8, wherein said second filler material is comprised in an amount of 14–26 Vol.-%.

* * * * *